US008657207B2

(12) United States Patent
Back et al.

(10) Patent No.: US 8,657,207 B2
(45) Date of Patent: Feb. 25, 2014

(54) HOT WATER CIRCULATION SYSTEM ASSOCIATED WITH HEAT PUMP AND METHOD FOR CONTROLLING THE SAME

(75) Inventors: Hyun Sam Back, Changwon (KR); Jin Woo Cho, Changwon (KR)

(73) Assignee: LG Electronics Inc., Seoul (KR)

( * ) Notice: Subject to any disclaimer, the term of this patent is extended or adjusted under 35 U.S.C. 154(b) by 1010 days.

(21) Appl. No.: 12/314,026

(22) Filed: Dec. 2, 2008

(65) Prior Publication Data

US 2010/0051713 A1 Mar. 4, 2010

(30) Foreign Application Priority Data

Aug. 26, 2008 (KR) ..... 10-2008-0083312
Aug. 26, 2008 (KR) ..... 10-2008-0083313

(51) Int. Cl.
*F24D 11/02* (2006.01)
*G05B 13/00* (2006.01)

(52) U.S. Cl.
USPC ..... 237/2 B; 62/259.1; 700/276; 700/278; 700/282; 700/299

(58) Field of Classification Search
USPC ..... 237/2 B; 62/259.1; 700/282, 278, 276, 700/299
See application file for complete search history.

(56) References Cited

U.S. PATENT DOCUMENTS 4,590,771 A * 5/1986 Shaffer et al. ..... 62/156
5,052,189 A * 10/1991 Akiike ..... 62/197
5,095,715 A * 3/1992 Dudley ..... 237/2 B
5,156,010 A * 10/1992 Inoue et al. ..... 62/81
5,538,072 A * 7/1996 Burkhart et al. ..... 237/2 B
5,727,395 A * 3/1998 Guo et al. ..... 62/156
5,797,273 A * 8/1998 Guo et al. ..... 62/156
6,467,284 B1 * 10/2002 Chen et al. ..... 62/156
6,729,390 B1 * 5/2004 Toth et al. ..... 237/2 B
2003/0116637 A1 * 6/2003 Ellingham ..... 237/2 B
2006/0230770 A1 * 10/2006 Kitsch ..... 62/151
2007/0209789 A1 * 9/2007 Oomura et al. ..... 62/229
2008/0135636 A1 * 6/2008 Sakai et al. ..... 237/2 B
2010/0077788 A1 * 4/2010 Lewis ..... 62/324.6
2010/0170273 A1 * 7/2010 Morimoto et al. ..... 62/176.6

FOREIGN PATENT DOCUMENTS

CN 1403746 A 3/2003
CN 1542355 A 11/2004
JP 2002162108 A * 6/2002 ..... F24H 1/00
JP 2002277082 A 9/2002
JP 2004078440 A 3/2004
JP 2007187345 A * 7/2007

(Continued)

OTHER PUBLICATIONS

Takisawa et al, CN 1403746 English translation, Mar. 19, 2003.*
Hong, CN 1542355 English translation, Nov. 3, 2004.*
Nomura et al, JP 2002-162108 A English translation, Jun. 7, 2002.*

(Continued)

*Primary Examiner* — Kang Hu
*Assistant Examiner* — Phillip E Decker
(74) *Attorney, Agent, or Firm* — McKenna Long & Aldridge LLP

(57) ABSTRACT

Disclosed is a hot water circulation system associated with a heat pump and a method for controlling the same. The present invention allows the system to be defrosted while hot water supply or a heating operation is performed, making it possible to improve a phenomenon that heating efficiency is deteriorated.

4 Claims, 5 Drawing Sheets

(56) References Cited

FOREIGN PATENT DOCUMENTS

| | | | | |
|---|---|---|---|---|
| JP | 2008020107 | A | | 1/2008 |
| JP | 2008121923 | A | | 5/2008 |
| JP | 2008241175 | A | | 10/2008 |
| JP | 2008275199 | A | * | 11/2008 |
| KR | 1020000075158 | A | | 12/2000 |
| KR | 100762513 | B1 | | 10/2007 |

OTHER PUBLICATIONS

Takisawa et al, CN 1403746A, Mar. 19, 2003, English translation.*
Cha, CN 1542355A, Dec. 30, 2003, English translation.*
Nomura et al, JP 2002-162108 A, Jun. 2002, English machine translation.*
Kim, KR 10-0762513 B1, Oct. 2, 2007, English machine translation.*

* cited by examiner

HOT WATER CIRCULATION SYSTEM ASSOCIATED WITH HEAT PUMP AND METHOD FOR CONTROLLING THE SAME

This application claims priority to Republic of Korea Patent Application Nos. 10-2008-0083312 and 10-2008-0083313, both filed Aug. 26, 2008, both of which are hereby incorporated by reference in their entireties.

BACKGROUND OF THE INVENTION

1. Field of the Invention

The present invention relates to a hot water supply and heating system associated with a heat pump and a method for controlling the same.

2. Description of the Related Art

A hot water supply and heating apparatus associated with a heat pump is an apparatus which is combined with a heat pump cycle and a hot water circulation unit and performs heat-exchange between water and refrigerant discharged from a compressor which constitutes a heat pump refrigerant circuit to perform a hot water supply and a floor heating.

In a conventional system, a pipe for water flowing along a closed cycle for heating is separated from that for supplying hot water, and heat exchange is performed at each different spot of the pipe on the outlet side of the compressor of the heat pump refrigerant circuit. That is, in the conventional system, a water-refrigerant heat exchanger for heating and a water-refrigerant heat exchanger for hot water supply are separate.

In the conventional system, water supplied for hot water supply performs heat-exchange with the refrigerant, while passing through the water-refrigerant heat exchanger for hot water supply, and is then directly discharged.

The hot water supply and heating apparatus associated with the heat pump having the structure as described thus has the following problems.

Firstly, when frost is generated on a surface of an evaporator which constitutes the heat pump refrigerant circuit and a defrosting operation is thus needed, heating and hot water supply functions must stop completely until the defrosting operation is finished. During the defrosting operation, the hot water cannot thus be supplied and indoor temperature is also reduced. If a heating operation is also performed while the defrosting operation is performed, heat is transferred from the water-refrigerant heat exchanger to the refrigerant, so a temperature of the circulating water drops to cause a drop in a temperature of an indoor floor.

Secondly, even though the hot water supply and heating are performed again after the defrosting operation is finished, it takes some time for the heating circuit reaches a normal level and the hot water supplied reaches a set temperature.

Thirdly, the water-refrigerant heat exchanger for heating and the water-refrigerant heat exchanger for hot water supply are separate, so an installation process is complicated and a manufacturing cost is increased.

SUMMARY OF THE INVENTION

Accordingly, the present invention is directed to a refrigerator that substantially obviates one or more problems due to limitations and disadvantages of the related art.

An object of the present invention is to provide a hot water circulation system associated with a heat pump which reduces an installation process and a manufacturing cost and allows a hot water supply to be performed smoothly even during a defrosting operation, and a method for controlling the same.

In particular, an object of the present invention is to provide a hot water circulation system associated with a heat pump which allows a defrosting operation to be performed, while a hot water supply is normally performed, and a method for controlling the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with an embodiment of the present invention, there is provided a method for controlling a hot water circulation system associated with a heat pump, the hot water circulation system associated with a heat pump comprising an outdoor unit including a compressor, an outdoor heat-exchanger, and an expansion part, and performing a heat pump refrigerant cycle; an indoor unit including a water-refrigerant heat-exchanger which performs heat exchange between a refrigerant discharged from the compressor and water, a water collection tank in which water passing through the water-refrigerant heat-exchanger is stored, and a water pump which pumps water discharged from the water collection tank; and a hot water circulation unit which receives heat from the water pumped from the water pump to perform hot water supply or heating, wherein the method comprises: sensing a refrigerant temperature T1 of the outdoor heat exchanger and a water temperature within a water pipe; and adjusting operation conditions of the outdoor unit and indoor unit simultaneously or selectively according to the values of the sensed refrigerant temperature T1 and water temperature T2.

In accordance with an embodiment of the present invention, there is provided a hot water circulation system associated with a heat pump, comprising: an outdoor unit including a compressor, an outdoor heat-exchanger, and an expansion part, and performing a heat pump refrigerant cycle; an indoor unit including a water-refrigerant heat-exchanger which performs heat exchange between a refrigerant discharged from the compressor and water, a water collection tank in which water passing through the water-refrigerant heat-exchanger is stored, and a water pump which pumps water discharged from the water collection tank; and a hot water circulation unit which receives heat from the water pumped by the water pump to perform hot water supply or heating, wherein the outdoor unit further includes a by-pass means which allows a portion of a refrigerant discharged from the compressor to be by-passed to the outdoor heat-exchanger, when a temperature of the outdoor heat-exchanger is lower than a defrosting requisite temperature while hot water supply or heating is performed.

In accordance with another embodiment of the present invention, there is provided a method for controlling a hot water circulation system associated with a heat pump, the hot water circulation system associated with a heat pump comprising an outdoor unit including a compressor, an outdoor heat-exchanger, and an expansion part, and performing a heat pump refrigerant cycle; an indoor unit including a water-refrigerant heat-exchanger which performs heat exchange between a refrigerant discharged from the compressor and water, a water collection tank in which water passing through the water-refrigerant heat-exchanger is stored, and a water pump which pumps water discharged from the water collection tank; and a hot water circulation unit which receives heat from the water pumped by the water pump to perform hot water supply or heating, wherein when a temperature of the outdoor heat-exchanger is lower than a defrosting requisite temperature while hot water supply or heating is performed, the system is controlled such that a portion of a refrigerant discharged from the compressor is by-passed to the outdoor heat-exchanger, and the water pump maintains its driving state.

According to a hot water circulation system associated with a heat pump having the configuration as described above and a method for controlling the same, hot water supply and floor heating can be performed selectively using a single hot water circulation closed cycle.

More specifically, a single water-refrigerant heat-exchanger performing heat exchange with a heat pump refrigerant cycle is provided, making it possible to reduce an installation process and a manufacturing cost of the system.

Hot water supply can also be performed smoothly even while a defrosting operation is performed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, the exemplary embodiments of the present invention will be described in more detail with reference to the accompanying drawings.

Figure 1:
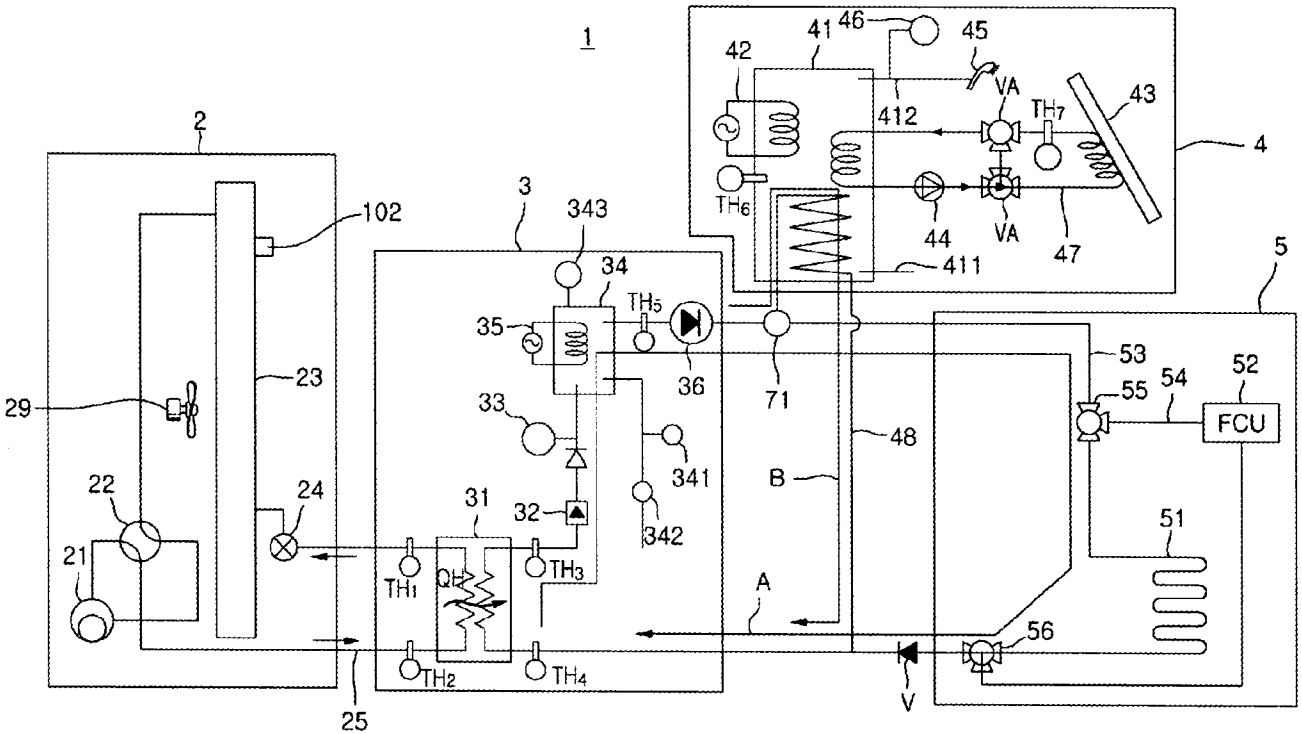
FIG. 1 is a view showing a hot water circulation system associated with a heat pump according to a first embodiment of the present invention.
Figure 2:
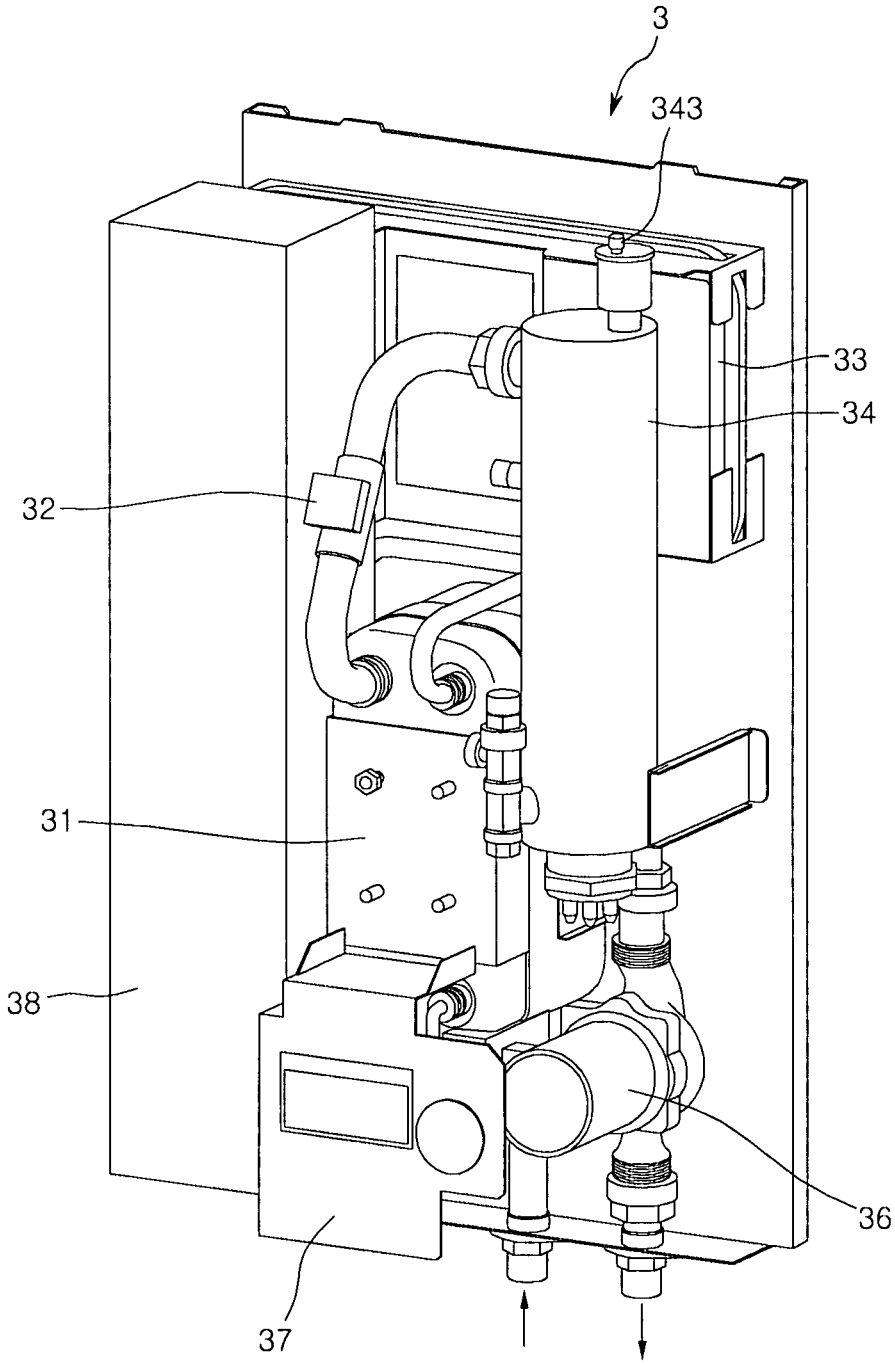
FIG. 2 is a perspective view showing a configuration of an indoor unit which constitutes the hot water circulation system associated with the heat pump.

FIG. 1 is a view showing a hot water circulation system associated with a heat pump according to a first embodiment of the present invention, and FIG. 2 is a perspective view showing a configuration of an indoor unit which constitutes the hot water circulation system associated with the heat pump.

Referring to FIGS. 1 and 2, the hot water circulation system associated with a heat pump 1 includes an outdoor unit 2 in which a heat pump refrigerant cycle is included, an indoor unit 3 which heats water by performing heat-exchange with a refrigerant whose phase is changed along the heat pump refrigerant cycle, a hot water supply unit 4 which is connected heat-exchangeably to a portion of the indoor unit 3 to supply hot water, and a heating unit which consists of a water pipe extended from the indoor unit 3.

More specifically, the heat pump refrigerant cycle includes a compressor 21 which compresses a refrigerant at high temperature and at high pressure, a four-way valve 22 which controls a flow direction of the refrigerant discharged from the compressor 21, a water-refrigerant heat exchanger 31 which performs heat exchange between the high-temperature and high-pressure refrigerant which has passed through the four-way valve 22 and water flowing along a water pipe of the indoor unit 3, an expansion part 24 which expands the refrigerant which has passed through the water-refrigerant heat exchanger 31 at low temperature and at low pressure, and an outdoor heat-exchanger 23 which performs heat-exchange between the refrigerant which has passed through the expansion part and outdoor air. A temperature sensor (not shown) is attached to the outdoor heat-exchanger 23 to sense a temperature of a pipe surface of the outdoor heat-exchanger 23. That is, it is determined whether a defrosting operation is needed according to a pipe temperature value sensed by the temperature sensor. These components are connected to each other through a refrigerant pipe 25 to form a closed cycle. The outdoor unit 2 includes the compressor 21, the four-way valve 22, the expansion unit 24, and the outdoor heat-exchanger 23. When the outdoor unit 2 is operated in a cooling mode, the outdoor heat-exchanger 23 functions as a compressor, and when the outdoor unit 2 is operated in a heating mode, the outdoor heat-exchanger 23 functions as an evaporator. Respective temperature sensors TH1, TH2 may be mounted on refrigerant pipes on inlet and outlet sides of the water-refrigerant heat-exchanger 31.

Hereinafter, the present invention will be described by limiting the hot water circulation system associated with a heat pump 1 to be operated in a heating mode, excepting for the case when the hot water circulation system associated with a heat pump 1 is operated in a defrosting operation.

The indoor unit 3 includes the water-refrigerant heat-exchanger 31, a flow switch which is mounted on the water pipe extended to an outlet side of the water-refrigerant heat-exchanger 31 to sense the flow of water, an expansion tank 33 which is branched at a certain spot spaced from the flow switch 32 in the flow direction of water, a water collection tank 34 to which an end of the water pipe extended from the outlet side of the water-refrigerant heat-exchanger 31 is inserted and an auxiliary heater 35 is provided therein, and a water pump 36 which is provided at a certain spot of the water pipe on the outlet side of the water collection tank 34.

More specifically, the water-refrigerant heat-exchanger 31 is a portion where the heat-exchange is performed between the refrigerant flowing along the heat pump refrigerant cycle and water flowing along the water pipe, and a plate-type heat-exchanger may be applied to the water-refrigerant heat-exchanger 31. In the water-refrigerant heat-exchanger 31, heat QH is transferred from the high-temperature high-pressure gas refrigerant passing through the compressor 21 to the water flowing along the water pipe. The water flowing into the water-refrigerant heat-exchanger 31 is tepid through the hot water supply process or the heating process. Respective temperature sensors TH3, TH4 may be mounted on water pipes on inlet and outlet sides of the water-refrigerant heat-exchanger 31.

When the volume of water heated by passing through the water-refrigerant heat-exchanger 31 is expanded exceeding appropriated levels, the expansion tank 33 functions as a buffer absorbing the overexpanded water. Diaphragms are included inside the expansion tank 33 to move in response to the change of the volume of water. The inside of the expansion tank 33 is filled with nitrogen gas.

The water collection tank 34 is a container where the water passing through the water-refrigerant heat-exchanger 31 is collected. An auxiliary heater 35 is mounted to the inside of the water collection tank 34 to be selectively operated, when the quantity of heat sucked through the defrosting operation process or the water-refrigerant heat-exchanger 31 does not reach the quantity of heat requested. An air vent 343 is formed on the upper side of the water collection tank 34 to allow air overheated in the water collection tank 34 to be exhausted. A pressure gage 341 and a relief valve 342 are provided on one side of the water collection tank 34 to enable the pressure inside the water collection tank 35 to be controlled appropriately. For example, when the water pressure inside the water collection tank 35 indicated by the pressure gage 341 is excessively high, the relief valve 342 is opened to ensure that the pressure inside the tank can be controlled appropriately. A temperature sensor TH5 which measures a water temperature may also be mounted on one side of the water collection tank 34.

Also, the water pump 36 pumps water discharged through the water pipe extended from the outlet side of the water collection tank 34 to supply the water to a hot water supply unit 4 and a heating unit 5.

Also, a control box 38 in which various electric components are stored is mounted on one side of the inside of the indoor unit 3, and a control panel 37 is provided on a front surface of the indoor unit 3. More specifically, the control panel 37 may include a display unit such as a LCD panel, and various input buttons. A user may check operation information such as an operation condition of the indoor unit 3 or a water temperature passing through the indoor unit 3 and other menu, etc., using the display unit.

The hot water supply unit 4 is a portion where water used for the user in washing his or her face or washing the dishes is heated and supplied.

More specifically, a channel switching valve 71 which controls the flow direction of water is provided at a certain spot spaced from the water pump 36 in the flow direction of water. The channel switching valve 71 may be a three-way valve which allows the water pumped by the water pump 36 to be flowed to the hot water supply unit 4 or the heating unit 5. A hot water supply pipe 48 extended to the hot water supply unit and a heating pipe 53 extended to the heating unit 5 are thus connected to the outlet side of the channel switching valve 71, respectively. The water pumped by the water pump 36 is selectively flowed to any one of the hot water supply pipe 48 and heating pipe 53 according to the control of the channel switching valve 71.

The hot water supply unit 4 includes a hot water supply tank 41 in which water supplied from the outside of the hot water supply unit 4 is stored and heated, and an auxiliary heater 42 provided inside the hot water supply tank 41. An auxiliary heat source which supplies heat to the hot water supply tank 41 may further be included according to the installation form of the hot water supply unit 4. A heat storage tank 43 using a solar cell panel may be suggested as the auxiliary heat source. An inlet part 411 into which cold water is flowed and an outlet part 412 through which heated water is discharged are provided on one side of the hot water supply unit 4.

More specifically, a portion of the hot water supply pipe extended from the channel switching valve 71 is inserted into the hot water supply tank 41 to heat water stored inside the hot water supply tank 41. In other words, heat is transferred from high-temperature water flowing along the inside of the hot water supply pipe 48 to water stored in the hot water supply tank 41. In a certain case, additional heat may also be supplied by operating the auxiliary heater 42 and auxiliary heat source. The auxiliary heater 42 and auxiliary heat source may be operated when water must be heated in a short time, for example, when a user needs a considerable amount of hot water in order to take a shower. A temperature sensor which senses a water temperature may be mounted on one side of the hot water supply tank 41.

A hot water discharging apparatus such as a shower 45 or a home appliance such as a humidity 46 may be connected to the outlet part 412 according to embodiments. When the heat storage tank 43 using the solar cell panel is used as the auxiliary heat source, an auxiliary pipe 47 extended from the heat storage tank 43 may be inserted into the inside of the hot water supply tank 41. An auxiliary pump 44 which controls flow velocity inside a closed cycle of the auxiliary pipe and a direction switching valve VA which controls the flow direction of water inside the auxiliary pipe 47 may be mounted on the auxiliary pipe 47. A temperature sensor TH7 which measures a water temperature may also be mounted on any one side of the auxiliary pipe 47.

The structure of the auxiliary heat source such as the heat storage tank using the solar cell panel is not limited to the embodiment proposed above, but the auxiliary heat source may be mounted on other positions, having diverse forms.

Meanwhile, the heating unit 5 includes a floor heating unit 51 formed by burying a portion of the heating pipe 53 in an indoor floor, and an air heating unit 52 branched from any spot of the heating pipe 53 to be connected to the floor heating unit 51 in parallel.

More specifically, the floor heating unit 51 may be laid under the indoor floor in a meander line form, as shown in FIG. 1. The air heating unit 52 may be a fan coil unit or a radiator. In the air heating unit 52, a portion of an air heating pipe 54 branched from the heating pipe 53 is provided as a heat-exchange means. On the spots branched from the air heating pipe 54, channel switching valves 55, 56 such as a three-way valve are installed to allow the refrigerant flowing along the heating pipe 53 to be flowed onto the floor heating unit 51 and the air heating unit 52, or to be flowed onto only any one of the floor heating unit 51 and the air heating unit 52.

An end of the hot water supply pipe 48 extended from the channel switching valve 71 is combined at the spot spaced from an outlet end of the air heating pipe 54 in the flow direction of water. In a hot water supply mode, the water flowing along the hot water pipe 48 is thus put together into the heating pipe 53 again and is then flowed into the water-refrigerant heat-exchanger 31.

Here, a check valve V is installed on a spot required to cut off a counter flow, such as a spot where the heating pipe 48 and the heating pipe 53 are combined, making it possible to prevent the counter flow of water. In this regard, check valves can be installed on an outlet end of the air heating pipe 54 and an outlet end of the floor heating unit 51, respectively, instead of the method that the channel switching valve 56 is installed on the outlet ends.

Hereinafter, the flow of water occurring in the hot water circulation system associated with the heat pump will be described for each operation mode.

In the hot water supply mode, the flow of water is controlled by the channel switching valve 71 to be flowed onto the hot water supply pipe 48. Therefore, water circulates along a closed cycle B in which a water-refrigerant heat-exchanger 31, a water collection tank 34, a water pump 36, a channel switching valve 71 and a hot water supply pipe 48 are connected. During such a circulation process, cold water flowed into an inlet part 411 of the hot water supply tank 41 is heated and then discharged into the outside of the water supply tank 41 through an outlet part 412 thereof, thereby being supplied to a user.

In the heating mode, the flow of water is controlled by the channel switching valve 71 to be flowed onto the heating pipe 53. Therefore, water circulates along a closed cycle A in which a water-refrigerant heat-exchanger 31, a water collection tank 34, a water pump 36, a channel switching valve 71 and a hot water supply pipe 48 are connected. The water flowing along the heating pipe 53 thus flows onto the air heating unit 52 or the floor heating unit 51.

In the system having the configuration as described above, if the outdoor unit 2 performs a heat pump refrigerant cycle for a long time, a surface of the outdoor heat-exchanger 23 is frozen so that a heat-exchange with external air is not smooth. Therefore, when a temperature of the outdoor heat-exchanger 23 becomes below a setting temperature, ice formed on the surface of the outdoor heat-exchanger 23 should be removed by performing a defrosting operation.

Hereinafter, it will be described a controlling method for previously preventing a surface of the outdoor heat exchanger 23 from being frozen or removing frost formed on the surface of the outdoor heat-exchanger 23 by controlling the operating rate of the outdoor unit while the outdoor unit 2 is operated in a heating mode.

Figure 3:
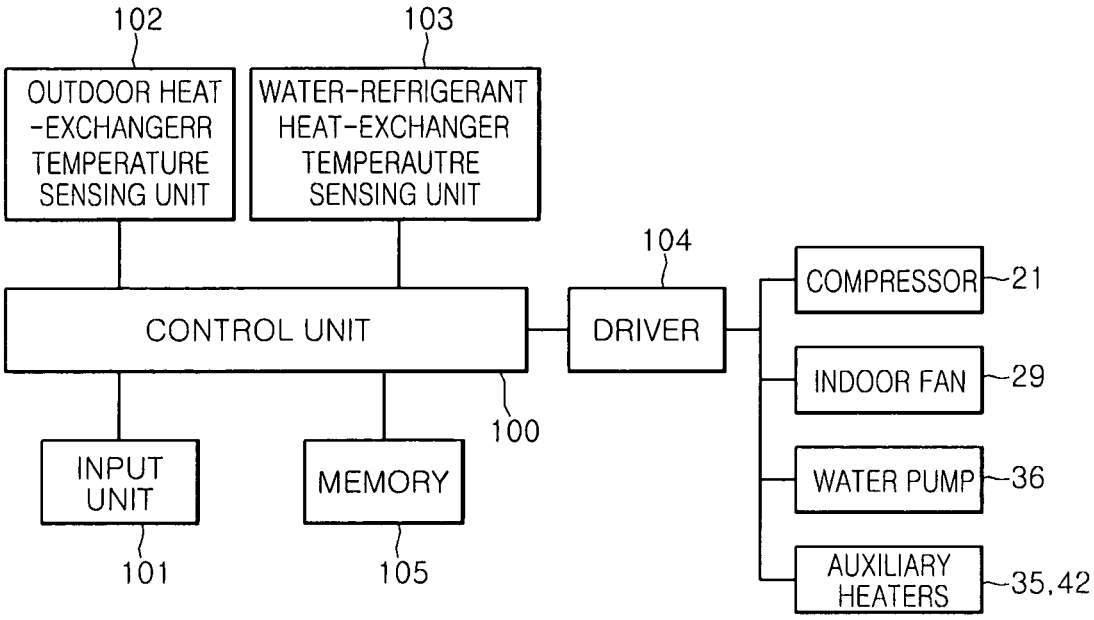
FIG. 3 is a schematic block diagram showing a control configuration of a hot water circulation system associated with a heat pump according to a first embodiment of the present invention.

FIG. 3 is a schematic block diagram showing a control configuration of a hot water circulation system associated with a heat pump according to a first embodiment of the present invention.

Referring to FIG. 3, the hot water circulation system associated with the heat pump 1 according to the first embodiment includes a control unit 100, an input unit 101 which inputs a command into the control unit 100, an outdoor heat-exchanger temperature sensing unit 102, a water-refrigerant heat-exchanger temperature sensing unit 103 which senses a temperature on an outlet side of the water-refrigerant heat-exchanger, a driver which operates according to a temperature value sensed by the temperature sensing units 102, 103, and a memory 105 in which reference values compared with the temperature value sensed by the sensing units 102, 103 and various information required in driving the system are stored.

More specifically, various input buttons provided on a control panel 37 of the indoor unit 3 are included in the input unit 101. A temperature sensor (not shown) attached to the outdoor heat-exchanger 23 is included in the outdoor heat-exchanger temperature sensing unit 102. Temperature sensors TH3 to TH5 mounted on a water pipe of the indoor unit are included in the water-refrigerant heat-exchanger temperature sensing unit 103, and the temperature sensors TH3 to TH5 are limited to a temperature sensor TH3 provided on an outlet side of the water-refrigerant heat-exchanger 31 in the present embodiment. An outdoor fan (not shown) mounted on the compressor 21, water pump 36, auxiliary heaters 35, 42 and outdoor heat-exchanger 23 is included in the driver 104.

With the control configuration as described above, a temperature value sensed by the outdoor heat-exchanger temperature sensing unit 102 and water-refrigerant heat-exchanger temperature sensing unit 103 is transferred to the control unit 100. The control unit 100 compares and determines the transferred temperature value with a reference value stored in the memory 105, and allows the driver 104 to perform a defrosting operation according to the result.

Figure 4:
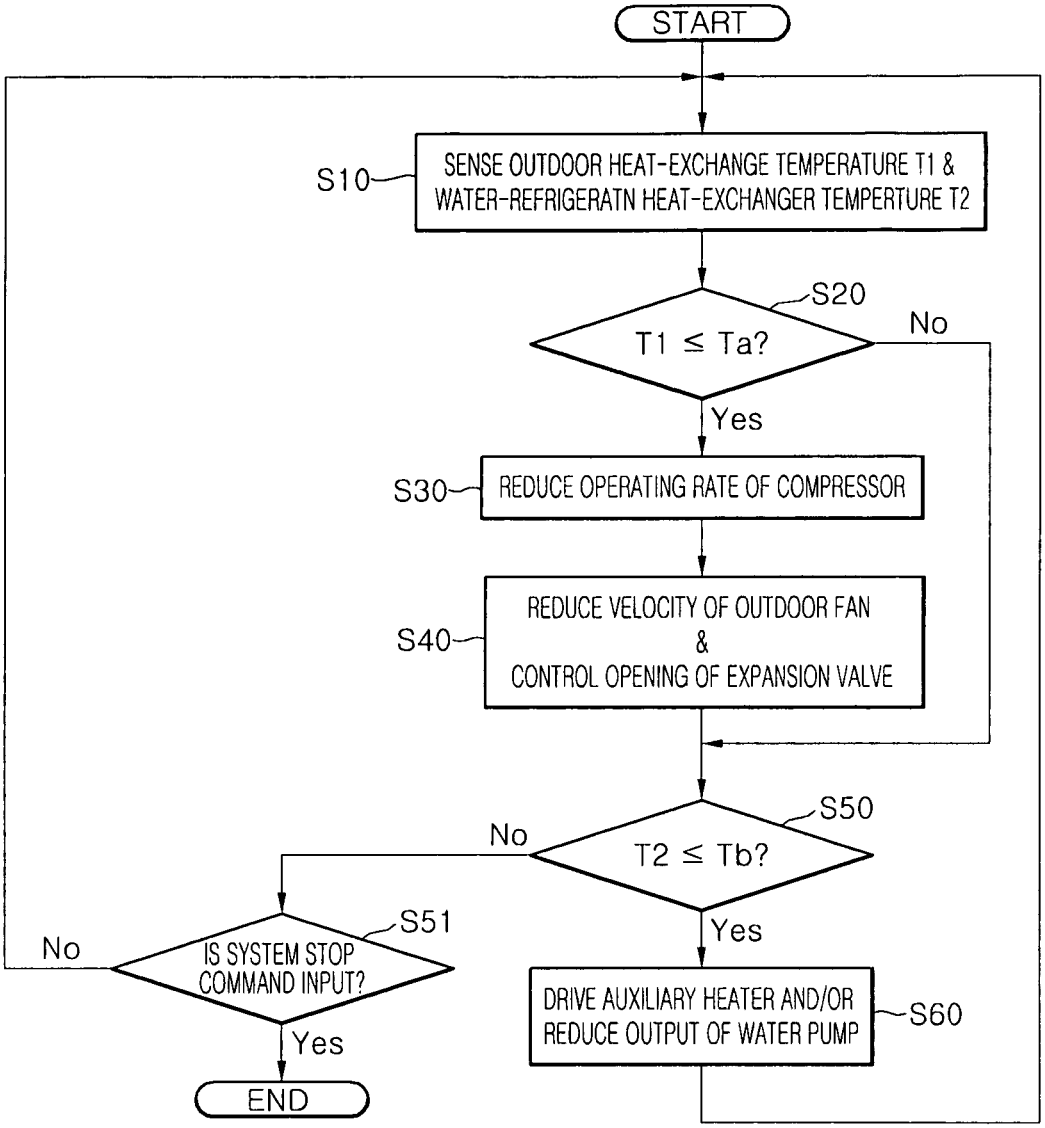
FIG. 4 is a flowchart showing a method for controlling a defrosting of a hot water circulation system associated with a heat pump according to a first embodiment of the present invention.

FIG. 4 is a flowchart showing a method for controlling a defrosting of a hot water circulation system associated with a heat pump according to a first embodiment of the present invention.

Referring to FIG. 4, while the system 1 operates, a temperature T1 of refrigerant pipe and a temperature of water passing through a water-refrigerant heat-exchanger 31 are sensed by the outdoor heat-exchanger temperature sensing unit 102 and water-refrigerant heat-exchanger temperatures sensing unit 103 (S10). In the control unit 100, it is determined whether the temperature T1 of refrigerant pipe drops to a defrosting requisite temperature Ta (S20).

When the temperature T1 of refrigerant pipe drops below a defrosting requisite temperature Ta, the operating rate of the compressor is reduced (S30). The velocity of the outdoor fan is also reduced and the opening of an expansion unit 24 is controlled, such that a temperature of the outdoor heat-exchanger 23 is increased (S40). Here, the expansion part 24 may be an electronic expansion valve (EEV) whose opening rate can be controlled, and hereinafter, the present embodiment will be described by exemplifying the expansion part as the electronic expansion valve.

More specifically, if the operating rate of the compressor 21 is reduced and the opening of the expansion part 24 is controlled according to the reduced operating rate, a temperature of an inlet of the outdoor heat-exchanger 23 is increased. In this state, the velocity of the outdoor fan is reduced to reduce heat emission to the external air, and instead, the heat is used in thawing frost formed on the surface of the outdoor heat-exchanger 23.

Meanwhile, after the operation condition of the outdoor unit 2 is changed, an operation to determine whether the water-refrigerant heat-exchanger 31 temperature T2 is lower than a setting temperature Tb (S50) is performed. Furthermore, even when the temperature T1 of refrigerant pipe is maintained to be higher than the defrosting requisite temperature Ta and it is thus determined that the surface of the outdoor exchanger 23 is not frozen or the freezing is not performed enough to a level that a defrosting operation is required, the operation S50 is performed.

More specifically, in the control unit 100, it is determined whether a temperature T2 of the water-refrigerant heat-exchanger is lower than a setting temperature Tb. Herein, the setting temperature Tb is a reference temperature value for changing an operation state of the indoor unit 3. For example, when a water temperature on an outlet side of the water-refrigerant heat-exchanger 23 is lower than the setting temperature Tb, a hot water supply function or a heating function may not be smoothly performed. In this case, there is a need that an auxiliary heater 35 mounted on the water collection tank 34 or an auxiliary heater 42 mounted on the hot water supply tank 41 is operated selectively, or an output of the water pump 36 is controlled. As described above, the setting temperature Tb may be a reference temperature that determines whether a driver 104 provided on the indoor unit 3 operates, or a reference temperature that controls an operation state of the driver 104.

More specifically, when the temperature T2 of the water-refrigerant heat-exchanger drops below the setting temperature Tb, the auxiliary heaters 35, 42 operate to allow a temperature of water circulating along a water pipe to be maintained in a normal operation state (S60). An output of the water pump 36 is reduced selectively or simultaneously with the operation of the auxiliary heaters 35, 42, such that the flow velocity of water passing through the water-refrigerant heat-exchanger 31 is reduced (S60). Then, the flow velocity of water passing through the water-refrigerant heat-exchanger 31 is reduced, such that a time of heat exchange is lengthened. Therefore, a temperature of water on an outlet side of the water-refrigerant heat-exchanger 31 is increased.

Here, the driving process of the auxiliary heaters 35, 42 and the process to reduce an output of the water pump may be selectively or simultaneously performed. The two processes may also be sequentially performed. During an installation process of the system 1, driving conditions may be set by an installer or may be previously programmed in the control unit.

Also, a multi-stage control of the auxiliary heaters 35, 42 may be performed according to a water temperature within the water pipe. More specifically, as an amount of current supplied to the auxiliary heaters 35, 42 is increased in stages according to the water temperature within the water pipe, a temperature of the heaters may be increased in stages. Alternately, a plurality of heaters are mounted on the water collection tank 34 or the water supply tank 41, such that the number of operating heaters may vary according to the water temperature.

Meanwhile, when it is determined that the water-refrigerant heat-exchanger temperature T2 is higher than the setting temperature Tb, in the control unit 100, it is determined whether a system stop command is input, such that a process to control the operation of the driver according to the outdoor heat-exchanger temperature T1 and water-refrigerant heat-exchanger temperature T2 (hereinafter, S10) is performed repeatedly until a system stop command is input.

With the control method of the system as described above, a defrosting operation is performed before a temperature of a surface of the outdoor heat-exchanger 23 drops to a defrosting requisite temperature, having an effect that a hot water supply or a heating operation is maintained continuously. That is, a defrosting effect can be obtained without performing a separate defrosting operation such as that an outdoor unit switches an operation condition from a heating cycle to a cooling cycle. The defrosting effect be obtained without interrupting the operation of the hot water circulation system, hot water supply can be made continuously to a user and a floor heating can be maintained as a setting level.

Figure 5:
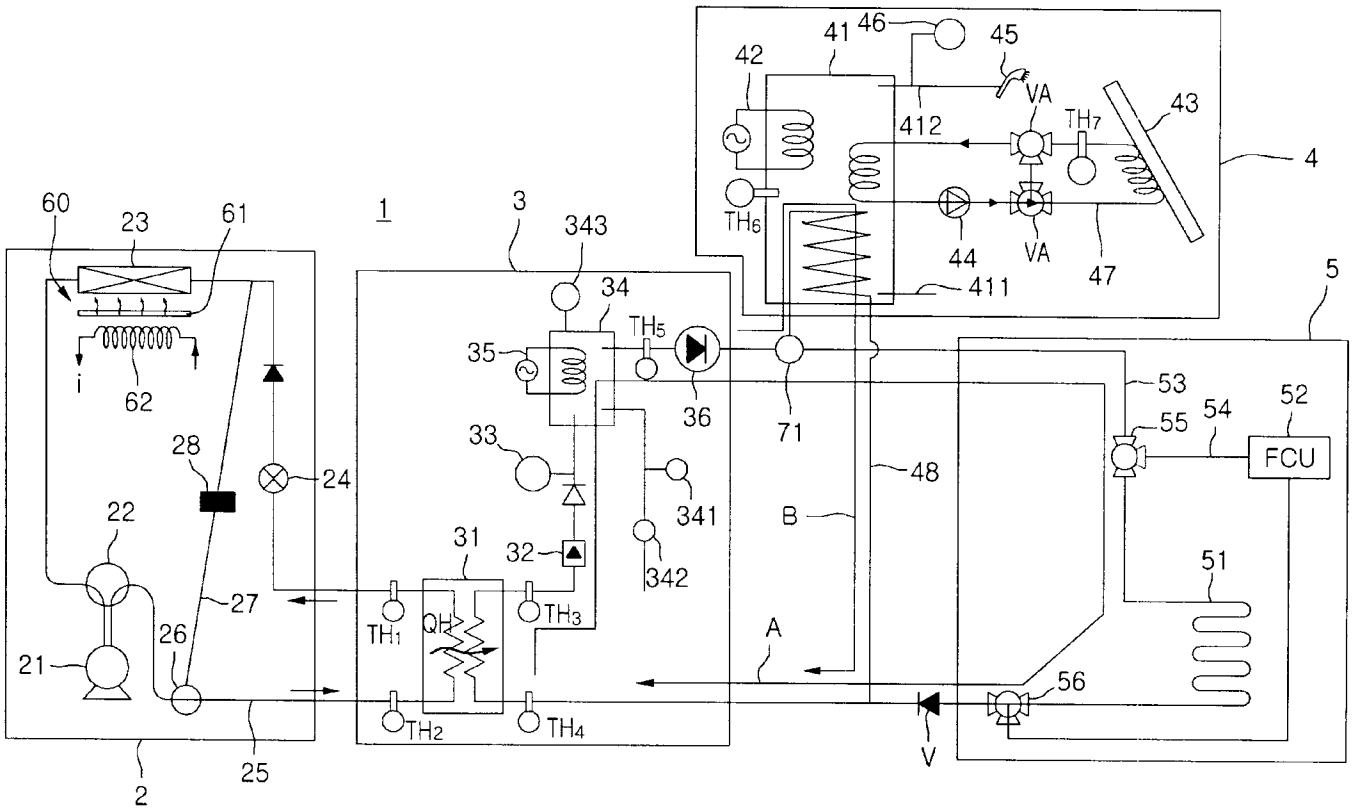
FIG. 5 is a configuration view of a hot water circulation system associated with a heat pump according to a second embodiment of the present invention.

FIG. 5 is a configuration view of a hot water circulation system associated with a heat pump according to a second embodiment of the present invention.

Referring to FIG. 5, the second embodiment has the same configurations including the indoor unit 2, hot water supply unit 4 and heating unit 5 as those shown in the first embodiment, but has a difference in the configuration of an outdoor unit 2. Therefore, the configurations excepting for the outdoor unit 2 will not be repeated.

More specifically, the outdoor unit 2 of the hot water circulation system associated with the heat pump 1 has the same configurations including a compressor 21, a four-way valve 22, an outdoor heat-exchanger 23, and an expansion part as those shown in FIG. 1. The outdoor unit 2 also has the same configuration that a temperature sensor is mounted on the outdoor heat-exchanger 23. Furthermore, in the present embodiment, a by-pass valve 26 is mounted on a discharge side of the compressor 21 to allow a portion of a refrigerant discharged from the compressor 21 to be by-passed to an inlet side of the outdoor heat-exchanger 23 when a defrosting operation is required.

More specifically, a by-pass pipe 28 is extended from the by-pass valve 26 to be connected to an inlet side of the outdoor heat-exchanger 23. A pressure reduction device 28 is provided on any one side of the by-pass pipe 27 to allow the pressure of the by-passed refrigerant to be decreased to the pressure on an inlet side of the outdoor heat-exchanger 23.

Also, an induction heater 60 may be mounted on an outer side of the outdoor heat-exchanger 23, the induction heater 60 generating heat using induced current by means of magnetic field.

More specifically, the induction heater 60 includes a coil 62 in which current flows to generate magnetic field, and a ceramic plate 61 provided on an upper side of the coil for insulation.

Generally, the induction heater 60 is a heater using induced current generated by means of magnetic field as a heat source and is consist of an electromagnet through which high-frequency alternating current can pass. The electromagnet is formed in a shape that the coil 62 is wound on a conductor.

Hereinafter, a heating function of the induction heater 60 will be described.

If alternating current passes through the coil 62, an alternating magnetic field whose direction changes according to a time is formed on the coil 62. The alternating magnetic force is then applied to the conductor wound on the coil 62, and a swirling current (eddy current) is generated by an electromagnetic induction phenomenon. The outdoor heat-exchanger 23 is heated by Joule heat generated by the swirling current. More specifically, if high-frequency current flows on the coil 62 in a state when the induction heater 60 is installed on an outer side of the outdoor heat exchanger 23, a magnetic force line 122 passes through the ceramic plate 61 and outdoor heat-exchanger 23. The induced current is then generated to the outdoor heat-exchanger 23 and as a result, a predetermined heat is generated. Therefore, frost or ice formed on a surface of the outdoor heat-exchanger 23 thaws.

The induction heater 60 is a heater to supply heat by means of induced current and is advantageous in view of the low heat loss and high efficiency.

For example, an air conditioner can perform a defrosting by the induction heater 60 until a temperature of an evaporator is −8° C. It can be appreciated that the defrosting ability is remarkably greater than a conventional defrosting method in which the defrosting operation can be performed only until a temperature of the evaporator is −1° C.

In the hot water circulation system associated with the heat pump 1 according to the second embodiment, a portion of a refrigerant passing through a compressor 21 is by-passed to an outdoor exchanger 23 before a temperature of the outdoor heat-exchanger 23 drops below a defrosting requisite temperature. That is, a portion of high-temperature refrigerant is supplied to the outdoor heat-exchanger 23 before the outdoor heat-exchanger 23 drops below the defrosting requisite temperature, thereby previously blocking the necessity of an defrosting operation.

In other words, if the temperature of the outdoor heat-exchanger 23 drops to the defrosting requisite temperature, the defrosting operation is not performed but a portion of high-temperature high-pressure refrigerant discharged from the compressor 21 is flowed into the evaporator 23. Then, a temperature of a surface of the evaporator 23 is increased, such that ice formed on the surface thaws.

More specifically, the by-pass valve 26 operates to allow a portion of the refrigerant discharged from the compressor 21 to be flowed onto the by-pass pipe 27. Then, the refrigerant branched along the by-pass pipe 27 passes through a pressure reduction device and drops to the pressure on an inlet side of the outdoor heat-exchanger 23. The branched refrigerant is flowed into the outdoor heat-exchanger 23, such that a temperature of the outdoor heat-exchanger 23 is increased. As a result, moisture frozen on the surface of the outdoor heat-exchanger 23 thaws.

Here, although the by-pass valve 26 operates to perform the defrosting operation, the water pump 36 operates continuously to allow hot water to be circulated. Therefore, a hot water supply and a heating are performed smoothly even while the defrosting operation is performed. The opening of the by-pass valve 26 can be controlled according to the extent of freezing of the outdoor heat-exchanger 23.

Meanwhile, the defrosting of the outdoor heat-exchanger 23 is not completely performed only with the operation of the by-pass valve 26, that is, only with the control of opening of the by-pass valve 26, the induction heater 60 may be operated. In other words, the defrosting operation by means of the refrigerant by-pass and the defrosting operation by means of the induction heater 60 may be simultaneously performed. Alternatively, the induction heater may be driven prior to the refrigerant by-pass, and the refrigerant by-pass may be performed selectively according to the defrosting effect.

Also, if a portion of the refrigerant passing through the compressor 21 is by-passed to the outdoor heat-exchanger 23, an amount of heat exchange performed by the water-refrigerant heat-exchanger 31 may be reduced. In this case, an output of the water pump 36 is controlled. In other words, if the flow velocity within a water pipe is reduced by reducing the output of the water pump 36, the velocity of water passing through the water-refrigerant heat-exchanger 31 is reduced, making it possible to compensate for the amount of heat exchange. This is the same as that described in the first embodiment.

With the configuration as described above, a phenomenon that heat of water circulating the indoor unit 3, the hot water supply unit 5, or the heating unit 5 is taken away in the water refrigerant pipe 31 to be cooled is not generated. In other words, the defrosting effect can be obtained without performing the defrosting operation, and the stop of the operation of the hot water circulation may not be required. Therefore, the hot water supply can be performed to a user continuously and the floor heating can be maintained constantly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a hot water circulation system associated with a heat pump, the hot water circulation system comprising an outdoor unit including a compressor, an outdoor heat-exchanger having a refrigerant pipe, a first sensing device to sense a temperature T1 of the refrigerant pipe, an expansion part and an outdoor fan; an indoor unit including a water-refrigerant heat-exchanger which performs heat exchange between a refrigerant discharged from the compressor and water, a second sensing device to sense a temperature T2 within a water pipe of the water refrigerant heat exchanger, a water collection tank in which water passing through the water-refrigerant heat-exchanger is stored, and a water pump which pumps water discharged from the water collection tank; a hot water circulation unit which receives heat from the water pumped from the water pump to perform hot water supply or heating, the hot water circulation unit including a hot water supply tank in which water supplied from the outside of the hot water circulating unit is stored and an auxiliary heater provided in at least one of the water collection tank and the hot water supply tank wherein the method comprises:

sensing temperature T1 of the refrigerant pipe and temperature T2 within the water pipe;

performing a first operation including reducing an operating rate of the compressor, reducing a velocity of the outdoor fan, and controlling an opening of the expansion part when the temperature T1 drops below a first setting temperature Ta;

sensing the temperature T2 after completing the first operation; and performing a second operation including at least one of driving of the auxiliary heater and reducing an output of the water pump when the temperature T2 is below a second setting temperature Tb.

2. The method as claimed in claim 1, wherein the auxiliary heater is controllable in a multi-stage manner.

3. The method as claimed in claim 1, further comprising a plurality of auxiliary heaters, wherein a number of the auxiliary heaters in operation is adjusted with respect to a water temperature in the water collection tank or the hot water supply tank.

4. The method as claimed in claim 1, wherein the water temperature T2 is a temperature at an outlet side of the water-refrigerant heat-exchanger.

* * * * *